United States Patent [19]

Kegler et al.

[11] 3,960,704

[45] June 1, 1976

[54] MANUFACTURE OF ISOTROPIC DELAYED PETROLEUM COKE

[75] Inventors: William H. Kegler, Ponca City, Okla.; Marvin E. Huyser, Houston, Tex.

[73] Assignee: Continental Oil Company, Ponca City, Okla.

[22] Filed: Aug. 27, 1974

[21] Appl. No.: 500,985

[52] U.S. Cl. ..... 208/50; 208/3; 208/131; 423/445; 423/448

[51] Int. Cl.[2] ..... C10G 9/14

[58] Field of Search ..... 208/46, 50, 106, 131, 208/3, 4, 6

[56] References Cited

UNITED STATES PATENTS

| | | | |
|---|---|---|---|
| 2,347,805 | 5/1944 | Bell | 208/50 |
| 2,661,323 | 12/1953 | Kraft | 208/4 |
| 2,905,615 | 9/1959 | Arey | 208/50 |
| 3,112,181 | 11/1963 | Petersen et al. | 208/46 |
| 3,116,231 | 12/1963 | Adee | 208/50 |
| 3,673,080 | 6/1972 | Schlinger et al. | 208/131 |
| 3,702,816 | 11/1972 | Buchmann et al. | 208/50 |

*Primary Examiner*—Herbert Levine
*Attorney, Agent, or Firm*—Richard W. Collins

[57] ABSTRACT

Isotropic petroleum coke is produced by air blowing a petroleum residuum to produce a delayed coking feedstock having a particular softening point and then coking said air-blown residuum with or without diluent under delayed coking conditions.

2 Claims, No Drawings

MANUFACTURE OF ISOTROPIC DELAYED PETROLEUM COKE

This invention relates to the manufacture of delayed petroleum coke and particularly to the production of isotropic coke using petroleum residuum feedstock. The coking conditions are approximately the same as those for production of delayed petroleum coke.

Isotropic coke has thermal expansion approximately equal along the three major crystalline axes. This thermal expansion is normally expressed as CTE (i.e., coefficient of thermal expansion) over a given temperature range such as 30°–530°C or 30°–100°C. Isotropic coke is also indicated by a CTE ratio, which is the ratio of radial CTE divided by axial CTE measured on a graphitized extruded rod. Acceptable isotropic coke has a CTE ratio of less than about 1.5 or a CTE ratio in the range of about 1.0–1.5.

Isotropic coke is used to produce hexagonal graphite logs which serve as moderators in high temperature, gas-cooled nuclear reactors. This coke has been produced from natural products such as gilsonite. The production of such graphite logs from gilsonite and the use thereof are described in U.S. Pat. Nos. such as 3,231,521 to Sturges; 3,245,880 to Martin et al; and 3,321,375 to Martin et al. U.S. Pat. No. 3,112,181 to Peterson describes the production of isotropic coke using petroleum distillates. Contaminants such as boron, vanadium, and sulfur have prohibited the use of some materials as the source of isotropic coke suitable for use in nuclear reactors. Less than about 1.6 weight percent sulfur is preferred to avoid puffing problems upon graphitization and fabrication of the coke. Supply of isotropic coke has been limited by availability of source materials, such as gilsonite and expensive petroleum distillates.

It has been discovered that exceptionally good quality isotropic coke can be produced by a particular process using residual petroleum feedstock which was previously considered unsuitable for good quality isotropic coke. This residuum is generally bottoms from virgin crude stock fractionation referred to herein as resid. This process is a particular combination of air blowing a petroleum resid feedstock to a particular softening point. This process is similar to air blowing resid to produce asphalt. The air-blown resid is subjected to delayed coking conditions to produce the isotropic coke. The isotropic coke produced by this invention has relatively low concentrations of impurities and acceptable quality for use in nuclear reactors. Furthermore, preferred processes of this invention produce unique cokes. One variety produced by use of a high recycle ratio or high diluent fraction during coking is a pellet coke which resembles lead shot and flows readily. Another variety is a high kerosene density coke which has a density of about 2.0 grams per cubic centimeter (g/cc) or higher. This high density coke produces graphite which is readily fabricated and machined.

Delayed coking, calcining, and air blowing petroleum resid are described in U.S. Pat. Nos. 3,116,231 to Adee; 3,173,852 to Smith; and 3,112,181 to Petersen. Adee describes a delayed coking process using liquid hydrocarbon residuum feedstock with a commercial delayed coking unit. Smith describes a similar delayed coking process and calcining delayed petroleum coke in particular using an inclined rotary calcining kiln.

Petersen describes the production of isotropic coke using petroleum distillate feedstocks with an oxygen pretreatment and conventional coking process. The process of this invention uses delayed coking conditions and particularly premium grade delayed coking conditions. Delayed coke manufacturing, as used herein, refers to the formation of coke in a coke drum, such as described in U.S. Pat. No. 2,922,755 to Hackley. This delayed coking process typically uses petroleum feedstock, such as residuum or a mixture of various petroleum fractions to produce an isotropic coke which has a low CTE. Premium delayed coke is used to produce products such as metallurgical graphite electrodes.

This invention provides a delayed coking process for producing isotropic coke comprising air blowing a petroleum residuum at about 500°–600°F with about 30–60 SCF of air per ton of residuum to produce a delayed coking feedstock having a softening point in the range of about 120°–240°F. This feedstock is heated to a temperature in the range of about 850°–950°F and charged to a delayed coking drum at a pressure in the range of about 15–250 psig, forming isotropic delayed coke in said drum and finally recovering said isotropic coke having a CTE ratio of less than about 1.5. Furnace coking problems occur at higher temperatures. The petroleum resid starting material is preferably a vacuum or atmospheric reduced crude. It can contain small amounts of other bottom or residual fractions. It is air blown under typical asphalt production conditions to a softening point of about 120°–240°F, and preferably 140°–200°F. The air-blowing and delayed coking operations can be conducted either as batch or continuous operation.

The air-blown resid is subjected to delayed coking conditions by heating the resid to a temperature in the range of about 850°–950°F, preferably about 900°–920°F. The heated feedstock is charged to a delayed coking drum at a pressure in the range of about 15–250 psig, preferably 20–80 psig. Isotropic delayed coke is formed in the drum, and volatile products are recovered overhead. The air-blown resid can be subjected to delayed coking either as it comes from the air-blowing unit or diluted with a diluent oil, such as premium coker gas oil, to reduce viscosity. Any highly aromatic oil which does not contribute substantially to coke yield such as premium coker gas oil can be used as a diluent fraction. A preferred coking process uses a diluent oil and/or a high recycle ratio to produce a free-flowing pellet-type isotropic coke. This pellet-type coke produced in the presence of said diluent fraction may require some crushing or grinding to loosen the pellets from porous coke mass in some cases.

The air-blowing operation is substantially the same as that for producing asphalt. Such air-blowing operations are described in the patents cited above and reference such as the Fourth Edition of Petroleum Refinery Engineering by W. L. Nelson. The reduced crude residuum charge is heated to an operating temperature of about 500°–600°F, which is slightly below its flash point. The charge is contained in a simple tank or column and blanketed with an inert atmosphere, such as steam, carbon dioxide, or nitrogen. Air is bubbled or blown through the residuum at a rate of about 30–60 standard cubic feet per minute per ton of residuum. SCF, or standard cubic feet as used herein, refers to 1 atmosphere and 60°F. Air is blown through the charge until it reaches the desired softening point of about 120°–240°F. A preferred softening point range is about 140°–200°F, which approximately corresponds to a penetration value of about 80–95.

After air-blowing, the charge is preferably diluted or cut with a fraction such as an aromatic crack stock; for example, premium coker gas oil or similar product which does not substantially coke. This diluent is merely to reduce viscosity and permit easier handling and pumping of the charge for the delayed coking process. The air-blown charge, with or without diluent, is heated to a temperature in the range of about 800°–1,200°F in a coker heater and subjected to delayed coking conditions in a delayed coking drum.

In a delayed coking process, a petroleum fraction which is normally a liquid hydrocarbon is heated and thermally decomposed into coke and gaseous products in a delayed coking drum. The liquid hydrocarbon feedstock is fed into a coker heater where it is heated to the desired high temperature range under a pressure up to about 250 psig. It is then fed into the bottom of a delayed coking drum under conditions of time, temperature, and pressure which promote the formation of coke and permit the evolution of gaseous products. The gaseous products are removed overhead from the drum. The thermal decomposition produces a heavy tar and a porous coke mass in which the tar undergoes additional decomposition while heated feedstock is being introduced into the drum. The oil fraction is typically a residual oil or a blend of residual oils and can contain other fractions such as diluents.

A preferred process of this invention uses a high diluent feedstock or a high recycle ratio. The high diluent feedstock contains up to about 50 volume diluent or cutting oil which does not substantially coke. A high recycle ratio during a continuous coking operation serves the same purpose as a high diluent concentration. The recycle ratio for a delayed coking operation can readily be seen by referring to the coking operation described by Adee in U.S. Pat. No. 3,116,231. The recycle ratio is a volumetric ratio of furnace charge to fresh feed fed to the continuous delayed coking operation as shown by Adee. The fresh feed is the residuum stream charged to the fractionator. The furnace feed or furnace charge is the stream withdrawn from the bottom of the fractionator. It passes through the coker heater and into the bottom of the coke drum. Since the fresh feed is fed into the fractionator, the furnace charge is considered to be a mixture of the fresh feed and recycle streams. Condensed overhead gaseous products are considered to be a recycle stream. Undoubtedly, some stripping and scrubbing of the streams occur in the fractionator. The recycle ratio for a process of this invention can be in the range of about 1.0–5.0. It is preferably at least about 2.0. This would indicate that about 1 volume of recycle products from the coke drums is mixed with 1 volume of fresh feed for each 2 volumes of furnace charge. The condensed overhead gaseous products from the coke drums are considered to be a recycle stream which does not substantially coke. For a recycle ratio of 1.0, the furnace charge would be equivalent to the fresh feed stream. For a recycle ratio of 2.0, using a fresh feed stream of 100 percent air-blown residuum, the furnace charge would be 1 volume of recycle with 1 volume of air-blown residuum. For a recycle ratio of 2.0 with a fresh feed stream containing 50 percent diluent and 50 percent air-blown residuum, a furnace charge would contain 3 volumes of diluent or recycle with 1 volume of air-blown residuum. For the recycle ratio of 2.5 with a fresh feed stream containing 50 percent diluent and 50 percent air-blown residuum, the furnace charge would contain 2 volumes of diluent or recycle with 0.5 volume of air-blown residuum. The high recycle ratio or diluent concentration in the furnace charge is not essential to produce the isotropic coke of this invention but is desirable for ease in handling and for producing a pellet-type isotropic coke which is easily removed from the coking drum.

The coking charge or furnace charge can be heated by any of several methods, such as a heat exchanger which recovers heat from other product streams. It is typically heated directly by a pipe still in which it can be readily heated to a high temperature. Fresh feed, with or without diluent, can be heated directly and fed into a coker heater and the coking drum, or it can be fed into a fractionator which is typical of a commercial unit as shown by Adee. In a commercial unit, a feedstock is introduced into a fractionator where it blends with gases and liquid streams, such as coker gas oils, condensed gaseous products, and other fractions. Coker feedstock is withdrawn at the bottom of the fractionator and fed to a coker heater.

For a direct feed unit, the air-blown residuum is preferably blended with a diluent or cutter oil to reduce viscosity. This blend is then heated to the desired coking temperature, and the heated feedstock is introduced into the bottom of a coke drum where coke is formed. Gaseous products are removed and fractionated into the desired products. The recycle or gas oil fraction can be transferred to storage or blended with additional incoming feedstock as diluent for continuous operation.

Residuum streams which can be used to produce the isotropic coke of this invention are those which have not been subjected to extensive thermal or catalytic cracking; preferred feedstocks are atmospheric or vacuum reduced crudes. Small amounts of other residual components extract residuum, thermal tar, decant oils, and other residua or blends thereof can be used in the feedstocks of this invention. The essential feature of the feedstocks of this invention is thought to be the ability to form cross-linked molecules under air-blowing conditions.

The isotropic coke produced by the process of this invention has excellent quality, as indicated by a low CTE ratio and by low impurity concentrations. The CTE can be measured by any of several standard methods. One method of measuring CTE is described in Technical Air Force Report No. WADD TR 61–72, entitled "Physical Properties of Some Newly Developed Graphite Grades," issued in May, 1964. For the isotropic coke of this invention, the coke is crushed and pulverized, dried, and calcined to about 2,400°F. This calcined coke is sized so that about 50 percent passes through a No. 200 U.S. standard sieve. The coke is blended with coal tar pitch binder, a small amount of puffing inhibitor, and a small amount of lubricant. The dried mixture is extruded at about 1,500 psi into electrodes of about three-fourths-inch diameter and about 5 inches long. These electrodes are heated slowly and graphitized up to a temperature of about 850°C. The coefficient of thermal expansion is then measured in the axial and radial directions over the range of about 30°–530°C of electrode heated at a rate of about 20°C per minute. The CTE ratio, as used herein, is the ratio of the radial CTE to axial CTE.

Several samples of air-blown residuum are prepared from vacuum reduced crude. The resid is blanketed with steam and charged to a blowing column at the rate of about 100 barrels per hour at a temperature of about 550°–560°F. Air under atmospheric conditions is injected or blown through the residua charge at about 50 standard cubic feet per minute per ton of residua until the resid attains a softening point of about 140°–200°F. This corresponds to a penetration of about 80–95. Properties of these air-blown residua or asphalt samples are tabulated in Table 1. Table 1 shows the air-blown residua properties, including the method of testing and specifically the softening point in °F, viscosity in centistokes (i.e., CS), flash points in °F by the Cleveland open cup method (i.e., COC), and metallic elements as determined in parts per million (i.e., ppm) by X-ray fluorescence (i.e., XRF). A light premium coker gas oil diluent is blended with several samples of the air-blown asphalt to reduce viscosity. Properties of the premium coker gas oil are tabulated in Table 2. These feedstocks are coked by heating to a temperature of about 845°–855°F at a pressure of about 100 psig. Each is introduced at about 18 pounds per hour with a gas oil recycle rate of 3 pounds per hour directly into the coking drum at a temperature of about 925°F and 25 psig. Properties of the coke recovered, including metal contaminants, kerosene density, axial CTE, radial CTE, electrical resistivity, and the CTE ratio are in Table 3. Kerosene density is determined by drying coke sized to pass through a U.S. No. 100 sieve under vacuum at 100°–200°C. About 10 grams of coke are added to a 50– ml pycnometer containing standardized kerosene at 40°C.

Samples of air-blown vacuum residua, as prepared above, are blended with about 25 percent light premium coker gas oil and coked in a continuous commercial-type coker. These samples are coked by heating the blended feedstock to a temperature of about 910°F at about 240–250 psig with a recycle ratio of about 2.2–2.5. The heated feedstock is introduced to the coking drums at about 890°–900°F and a pressure of about 30–35 psig. Properties of the recovered coke are in Table 4.

TABLE 1

PROPERTIES OF AIR-BLOWN RESIDUA
ISOTROPIC COKE TEST RUN
PONCA CITY REFINERY

| Sample No. | ASTM Method | A | B | C | D |
|---|---|---|---|---|---|
| Softening Point | D-2398 | 200.5 | 139 | 177 | 181 |
| Specific Gravity, 60/60°F | | 1.0072 | 0.9842 | 0.9962 | 0.9979 |
| Sulfur, Wt % | D-1552 | 1.28 | 0.86 | 0.90 | 0.87 |
| Conradson Carbon Residue, Wt % | D-189 | 21.87 | 17.5 | 19.85 | 17.0 |
| Viscosity, CS, at | D-2170 | | | | |
| 210°F | | — | — | — | — |
| 250°F | | 18,425 | 1,437 | — | — |
| 275°F | | 5,968 | — | 4,341 | 12,639 |
| 300°F | | 2,211 | 294 | 1,747 | 1,730 |
| Flash, COC, °F | D-92 | — | 575 | 510 | 560 |
| Penetration, 0.1 mm 77/100/5 | D-5 | 22 | 67 | 23 | 28 |
| Ash | | 0.06 | 2.37 | — | — |
| Metallic Elements by X-ray Fluoroscopy | | | | | |
| Vanadium, ppm | | 55 | 48 | 42 | — |
| Nickel, ppm | | 22 | 20 | 30 | — |
| Iron, ppm | | 28 | 33 | 54 | — |
| Cu, ppm | | 2.4 | — | <2 | — |

TABLE 2

PROPERTIES OF THE LIGHT PREMIUM COKER GAS OIL USED AS A CUTTER STOCK FOR THE AIR-BLOWN ASPHALT

| Sample No. | E |
|---|---|
| Gravity, °API | 10.1 |
| Specific Gravity | 0.9993 |
| ASTM Distillation, D-1160, °F | |
| 5 | 445 |
| 10 | 468 |
| 20 | 522 |
| 30 | 563 |
| 40 | 595 |
| 50 | 619 |
| 60 | 639 |
| 70 | 655 |
| 80 | 666 |
| 90 | 723 |
| 95 | 755 |
| EP | — |
| % Rec | 92.0 |
| Sulfur, Total | 1.01 |
| Conradson Carbon Residue | 0.01 |
| Viscosity, CS, at 100°F | 5.38 |
| 130°F | 3.52 |
| 210°F | 1.59 |

TABLE 3

SUMMARY OF COKE PROPERTIES

| Run No. | 3–1 | 3–2 | 3–3 | 3–4 | 3–5 | 3–6 | 3–6 |
|---|---|---|---|---|---|---|---|
| Feedstock Description | A | 75% A 25% E | A | B | B | 75% C 25% E | 75% C 25% E |
| Green Coke | | | | | | | |
| Wt % Volatile Matter | 8.3 | 9.0 | 8.7 | 8.3 | 9.5 | 10.6 | 8.5 |
| Wt % Ash | 0.09 | 0.08 | 0.08 | 0.30 | 0.28 | 0.12 | 0.15 |
| Wt % Sulfur | 1.86 | 1.86 | 2.08 | 1.55 | 1.48 | 1.57 | 1.42 |
| Wt % Carbon | 91.4 | 91.3 | 91.3 | 90.5 | 90.3 | 89.5 | 90.0 |
| Wt % Hydrogen | 3.7 | 3.8 | 3.7 | 3.2 | 3.3 | 3.7 | 3.5 |
| Wt % Nitrogen | — | — | — | 1.3 | 1.4 | 1.2 | 1.2 |
| XRF Metals, ppm | | | | | | | |
| V | 170 | 190 | 160 | 170 | 110 | 97 | 110 |

TABLE 3-continued

| SUMMARY OF COKE PROPERTIES | | | | | | | |
|---|---|---|---|---|---|---|---|
| Run No. | 3-1 | 3-2 | 3-3 | 3-4 | 3-5 | 3-6 | 3-6 |
| Feedstock Description | A | 75% A 25% E | A | B | B | 75% C 25% E | 75% C 25% E |
| Ni | 87 | 96 | 88 | 88 | 60 | 80 | 100 |
| Fe | 62 | 72 | 73 | 68 | 37 | 79 | 180 |
| Cu | 4.5 | 8.0 | 7.7 | 5.8 | 5.0 | 7.4 | 10.0 |
| Calcined Coke | | | | | | | |
| Wt % Ash | 0.28 | 0.22 | 0.15 | 0.65 | 0.35 | 0.62 | 0.57 |
| Kerosene Density at 40°F | 2.08 | 2.09 | 2.08 | 2.07 | 2.08 | 2.06 | 2.05 |
| Graphitized Electrode | | | | | | | |
| Axial CTE × $10^{-7}$/°C* | 28.4 | 25.0 | 24.8 | 35.3 | 32.0 | 41.4 | 42.4 |
| Radial CTE × $10^{-7}$/°C* | 43.4 | 41.1 | 42.6 | 48.4 | 44.4 | 48.9 | 50.0 |
| Elect. Resistivity, (ohm - in. × $10^{-4}$) | 4.0 | 3.7 | 3.8 | 4.2 | 3.9 | 4.1 | 4.1 |
| CTE Ratio Over 30–530°C** | 1.41 | 1.49 | 1.54 | 1.30 | 1.31 | 1.15 | 1.15 |

*30–100°C range.
**Calculated from above figures for 30–100°C range.

TABLE 4

| SUMMARY OF COKE PROPERTIES ISOTROPIC COKE | | |
|---|---|---|
| Sample No. | 4-1 | 4-2 |
| Green Coke | | |
| Wt % Volatile Matter | 8.2 | 8.7 |
| Wt % Ash | 0.05 | 0.16 |
| Wt % Silfur | 1.47 | 1.46 |
| Wt % Carbon | 92.7 | 92.6 |
| Wt % Hydrogen | 4.2 | 3.7 |
| Wt % Nitrogen | 1.3 | 1.3 |
| XRF Metals, ppm | | |
| V | 110 | 120 |
| Ni | 94 | 99 |
| Fe | 98 | 93 |
| Cu | 6 | 5 |
| Calcined Coke | | |
| Wt % Ash | 0.75 | 0.63 |
| Kerosene Density at 40°F | | |
| Calcined at 2,200°F | — | 2.02 |
| 2,400°F | 2.04 | 2.04 |
| 2,600°F | — | 2.06 |
| Graphitized Electrode | | |
| Axial CTE × $10^{-7}$/°C* | 42.1 | 44.4 |
| Radial CTE × $10^{-7}$/°C* | 52.2 | 51.0 |
| Electrical Resistivity (ohm - in. × $10^{-4}$) | 4.6 | 4.4 |

TABLE 4-continued

| SUMMARY OF COKE PROPERTIES ISOTROPIC COKE | | |
|---|---|---|
| Sample No. | 4-1 | 4-2 |
| CTE Ratio Over 30–530°C** | 1.20 | 1.13 |

*30–100°C range.
**Calculated from data of 30–100°C range.

We claim:

1. A process for producing isotropic coke having a CTE ratio of less than 1.5 from reduced virgin crude oil comprising:
   a. air blowing said reduced virgin crude oil to a softening point of from 120° to 240°F;
   b. heating the air blown reduced virgin crude oil to a temperature of from 850° to 950°F;
   c. charging the heated reduced virgin crude oil to a delayed coking drum at a pressure of from 20 to 250 psig with a recycle ratio of from 1.0 to 5.0 to produce isotropic coke therein; and
   d. recovering isotropic coke having a CTE ratio of less than 1.5 from the coking drum.

2. The process of claim 1 wherein said reduced virgin crude oil is air blown at a temperature of from 500° to 600°F with from 30 to 60 SCF of air per ton of reduced virgin crude oil to a softening point of from 140° to 200°F, said pressure is from 20 to 80 psig, and said recycle ratio is at least 2.0.

* * * * *